United States Patent [19]

Shirai

[11] Patent Number: 4,895,784

[45] Date of Patent: Jan. 23, 1990

[54] PHOTOCONDUCTIVE MEMBER

[75] Inventor: Shigeru Shirai, Yamato, Japan

[73] Assignee: Canon Kabushiki Kaisha, Tokyo, Japan

[21] Appl. No.: 323,223

[22] Filed: Mar. 13, 1989

Related U.S. Application Data

[63] Continuation of Ser. No. 196,842, May 24, 1988, abandoned, which is a continuation of Ser. No. 102,231, Sep. 25, 1987, abandoned, which is a continuation of Ser. No. 946,619, Dec. 29, 1986, abandoned, which is a continuation of Ser. No. 859,222, May 5, 1986, abandoned, which is a continuation of Ser. No. 627,523, Jul. 3, 1984, abandoned.

[30] Foreign Application Priority Data

Jul. 15, 1983 [JP] Japan ..... 58-129047

[51] Int. Cl.[4] ..... G03G 5/082

[52] U.S. Cl. ..... 430/69; 430/56

[58] Field of Search ..... 430/56, 69; 355/3 DR

[56] References Cited

U.S. PATENT DOCUMENTS

| | | | |
|---|---|---|---|
| 3,490,841 | 1/1970 | Cely et al. | 355/3 DR |
| 4,225,222 | 9/1980 | Kempter | 355/3 DR |
| 4,226,898 | 10/1980 | Ovshinsky et al. | 430/84 X |
| 4,265,991 | 5/1981 | Hirai et al. | 430/67 X |
| 4,460,670 | 7/1984 | Ogawa et al. | 430/95 X |

FOREIGN PATENT DOCUMENTS

| | | | |
|---|---|---|---|
| 58-136043 | 8/1983 | Japan | 430/69 |

*Primary Examiner*—Roland E. Martin

*Attorney, Agent, or Firm*—Fitzpatrick, Cella, Harper & Scinto

[57] ABSTRACT

A photoconductive member comprises a drum-shaped substrate and a photoconductive layer provided thereon, said photoconductive layer comprising an amorphous material comprising silicon atoms as a matrix, and said drum-shaped substrate having a ratio of the minimum thickness at the end portion to the maximum thickness at the central portion of 0.2 or higher.

12 Claims, 2 Drawing Sheets

PHOTOCONDUCTIVE MEMBER

This application is a continuation of application Ser. No. 196,842, filed May 24, 1988, now abandoned, which, in turn, is a continuation of application Ser. No. 102,231, filed Sept. 25, 1987, now abandoned, which in turn is a continuation of application Ser. No. 946,619, filed Dec. 29, 1986, now abandoned, which, in turn, is a continuation of application Ser. No. 859,222, filed May 5, 1986, now abandoned, which, in turn, is a continuation of Application Ser. No. 627,523, filed July 3, 1984, now abandoned.

BACKGROUND OF THE INVENTION

1. Field of the Invention

This invention relates to a photoconductive member having sensitivity to electromagnetic waves such as light [herein used in a broad sense, including ultraviolet rays, visible light, infrared rays, X-rays, gamma-rays and the like.]

2. Description of the Prior Art

Photoconductive materials, which constitute image forming members for electrophotography in solid state image pick-up devices or in the field of image formation, or photoconductive layers in manuscript reading devices, are required to have a high sensitivity, a high SN ratio [Photocurrent ($I_p$)/Dark current ($I_d$)], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon in which dangling bonds are modified with mono-valent elements such as hydrogen or halogen atoms [hereinafter referred to as a-Si (H,X)] has recently attracted attention as a photoconductive material. For example, German Laid-Open Patent Publication Nos. 2746967 and 2855718 disclose their applications for use in image forming members for electrophotography, and German Laid-Open Patent Publication No. 2933411 its application for use in a photoconverting reading device. It is expected to be applied for electrophotography as an image forming member due to its excellent photoconductivity, friction resistance, heat resistance and relative easiness in forming into a large area device.

Generally, in production of an image forming member for electrophotography shaped in a drum having a photoconductive material comprising a-Si (H,X), for the purpose of obtaining good photoconductive characteristics, a-Si(H,X) film is formed on a drum-shaped substrate in a-Si(H,X) film depositing apparatus under the condition of heating the drumshaped substrate to a temperature of 200° C. or higher.

However, because there is difference in coefficient of thermal expansion between the drum-shaped substrate and a-Si(H,X) film and also because of great internal stress within the a-Si(H,X) film, peel-off of the a-Si(H,X) film is frequently observed not only during deposition of the a-Si(H,X) film but also during cooling after deposition. Further, during usage as the photosensitive drum for electrophotography, a Si-(H,X) film may sometimes be peeled off by heating of the drum. In particular, a-Si film is susceptible to peel-off at the end portions of the drum, sometimes with formation of a crack from the end portion of the drum to the central portion.

According to a number of experiments by the present inventors, such film peel-off or crack formation is more liable to occur as the a-Si(H,X) film is thicker, and film peel-off may also be caused in the case of the a-Si type drum-shaped image forming member with a deformation of the drum-shaped substrate which will not cause film peel-off in the Se type drum-shaped image forming member for electrophotography of the prior art, for the above-mentioned reasons of difference in coefficient of thermal expansion and the greatness of the internal stress within the a-Si(H,X) film. As to the internal stress within the a-Si(H,X) film, it can be alleviated to some extent by selection of the production conditions of the a-Si(H,X) film (starting material gas, discharging power, heating temperature of the substrate). However, such film peel-off or crack formation is a critical defect when applied for electrophotography, which may be a cause for image defect Generally speaking, the end portion of a drum is applied with a working for fixing the drum-shaped substrate within a manufacturing apparatus during production of a photoconductive member by deposition of a-Si(H,X) film or for fixing the drum-shaped photoconductive member for electrophotography in a copying machine. Since this working is generally practiced by cutting the inner face of the end portion, the end portion of the drum is thinner as compared with its central portion. Accordingly, heating of the drum-shaped substrate during forming a-Si(H,X) film is liable to cause thermal deformation particularly at its end portion, and this thermal deformation may be considered to be a cause for film peel-off or crack formation at the end portion of the drum. Also, such thermal deformation may be estimated to cause unevenness in discharging during deposition of a-Si film, whereby evenness in a thickness of the a-Si deposited film may be lost to give rise to an image defect.

The present invention has been accomplished in view of the various points as mentioned above. As the result of overall and extensive studies from viewpoint of applicability and utilization of a-Si for a photoconductive member to be used as an image forming member for electrophotography, solid state image pick-up device, reading device, etc., it has now been found that the above problem with respect to film peel-off and crack formation can be overcome by use of a drum-shaped substrate having a specific value of a ratio of the thickness of the end portion to that of the central portion as the support of a-Si deposited film. The present invention is based on such a finding.

SUMMARY OF THE INVENTION

An object of the present invention is to provide a photoconductive member for electrophotography which is scarce in image defect such as white drop-off or white streak and capable of giving an image of high quality.

Another object of the present invention is to provide a photoconductive member excellent in durability, which is constantly stable in electrical, optical and photoconductive characteristics without causing deterioration phenomenon even when used repeatedly.

According to the present invention there is to provide a photoconductive member, which comprises a drum-shaped substrate and a photoconductive layer provided thereon, said photoconductive layer comprising an amorphous material comprising silicon atoms as a matrix, said drum-shaped substrate having a ratio of the minimum thickness at the end portion to the maximum thickness at the central portion of 0.2 or higher.

DETAILED DESCRIPTION OF THE PREFERRED EMBODIMENTS

The photoconductive member of the present invention, in its preferred embodiment, is constituted of a drum-shaped, namely cylindrical support as the support of a photoconductive member, and a photoconductive layer comprising an amorphous material containing silicon atoms as a matrix and also containing at least one of hydrogen atoms and halogen atoms as constituent atoms formed on said drum-shaped substrate. Said photoconductive layer may also have a barrier layer provided in contact with the drum-shaped substrate, and further a surface barrier layer provided on the surface of said photoconductive layer.

Figure 1:
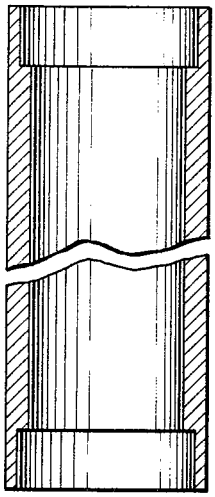
FIG. 1 and FIG. 2 show sectional views of typical shapes of the drum-shaped substrate to be used for the photoconductive member of the present invention.
Figure 2:
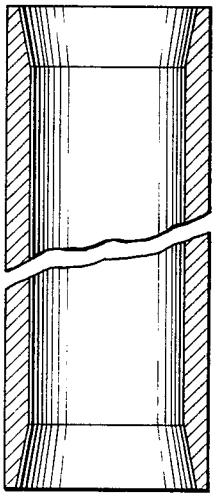

FIG. 1 and FIG. 2 show sectional views of typical shapes of the drum-shaped substrate to be used for the photoconductive member of the present invention. The outer face of the drum-shaped substrate exhibits a smooth cylindrical surface, and its end portion at the inner face is shaped in a certain area so as to be applied with a working for fixing to the manufacturing machine or the copying machine as mentioned above, with its thickness being made thinner than that of the central portion The drum-shaped substrate of the photoconductive member of the present invention has a ratio of the thickness at the end portion where the thickness becomes the thinnest to the thickness at the central portion where a constant thickness is generally exhibited, which is 0.2 or higher. Thus, by use of a drum-shaped substrate with a ratio of thickness at the end portion to that at the central portion of 0.2 or higher, even when the drum-shaped substrate may be heated during manufacturing of a photoconductive member in an a-Si film depositing device or during use as a photosensitive drum for electrophotography, the extent of thermal deformation of the drum-shaped substrate can be suppressed sufficiently small, whereby t is possible to reduce the film peel-off or crack formation within a practical range or even to zero. The ratio of the minimum thickness at the end portion of the drum-shaped substrate to the maximum thickness at the central portion may more preferably be 0.3 or higher, particularly preferably 0.5 or higher.

The base material for the drum-shaped substrate may be either electroconductive or dielectric. As the electroconductive support, there may be mentioned metals such as NiCr, stainless steel, Al, Cr, Mo, Au, Nb, Ta, V, Ti, Pt, Pd etc. or alloys thereof.

As dielectric supports, there may conventionally be used films or sheets of synthetic resins, including polyester, polyethylene, polycarbonate, cellulose acetate, polypropylene, polyvinyl chloride, polyvinylidene chloride, polystyrene, polyamide, etc.; glasses; ceramics; papers and so on. These dielectric supports may preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) etc. thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface.

As the base material for the drum-shaped substrate, it is preferred to use aluminum, because a substrate with good precision such as true sphericity, surface smoothness, etc. can be obtained with relative ease and the temperature at the surface portion deposited of a-Si can be controlled easily, and also in aspect of economy.

The halogen atom (X) which may be incorporated in the photoconductive layer of the photoconductive member of the present invention may be, for example, fluorine, chlorine, bromine and iodine, particularly chlorine and fluorine, and above all fluorine as the most preferable one. The components other than silicon atoms, hydrogen atoms and halogen atoms to be contained in the photoconductive layer may be the group III atoms of the periodic table such as boron, gallium, etc., the group V atoms such as nitrogen, phosphorus, arsenic, etc., oxygen atom, carbon atom, germanium atom, etc. singly or as a suitable combination, as the component for controlling the Fermi level or the forbidden band gap.

The content of hydrogen atoms or halogen atoms, or the total content of hydrogen atoms and halogen atoms in the photoconductive layer may be 1 to 40 atomic %, preferably 5 to 35 atomic %.

The barrier layer is provided for the purpose of improvement of adhesion between the photoconductive layer and the drum-shaped substrate or for the purpose of controlling the charge receiving ability. Depending on the purpose, a-Si layer or micro-crystalline Si-layer containing the group III atoms of the periodic table, and the group V atoms of the periodic table, such as oxygen atom, carbon atom, germanium atom, etc. may be formed in one layer or multiple layers.

It is also possible to provide, as the surface charge injection preventing layer or protective layer on the photoconductive layer, an upper layer of a-Si containing carbon atom, nitrogen atom, oxygen atom, etc. preferably in a large amount thereof or a surface barrier layer comprising a highly resistant organic substance.

In the present invention, for formation of a photoconductive layer constituted of a-Si, it is possible to apply various vacuum deposition method utilizing discharging phenomenon known in the art, such as the glow discharge method, the sputtering method or the ion plating method.

In the following, an example of a method for preparation of a photoconductive member formed according to the glow discharge decomposition method is to be described.

Figure 3:
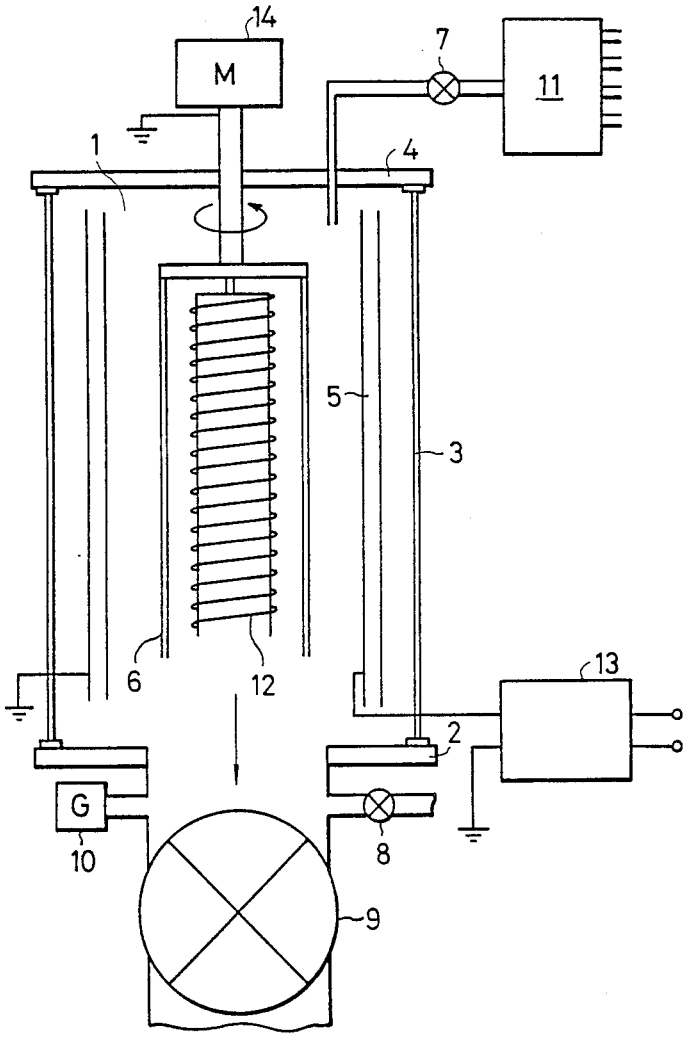
FIG. 3 shows a chart of a device for producing the photoconductive member according to the glow discharge decomposition method.

FIG. 3 shows a device for preparation of a photoconductive member according to the glow discharge decomposition method. The deposition tank 1 is constituted of a base plate 2, a tank wall 3 and a top plate 4, and within the deposition tank 1, there is provided a cathode electrode 5, the drum-shaped substrate 6 for forming the a-Si deposited film thereon being provided at the central portion of the cathode electrode 5 and functioning also as the anode electrode.

For formation of a-Si deposited film on the drum-shaped substrate by use of this preparation apparatus, first the deposition tank 1 is evacuated by closing the starting gas inflow valve 7 and the leak valve 8 and opening the evacuation valve 9. When the reading on the vacuum indicator 10 becomes $5\times10^{-6}$ Torr, the starting gas inflow valve 7 is opened, and a starting gas mixture of, for example, $SiH_4$ gas, $Si_2H_6$ gas and $SiF_4$ gas, controlled to a predetermined mixing ratio in the mass flow controller, is permitted to flow into the deposition tank 1. At that time, the degree of opening of the evacuation valve 9 is controlled while watching the reading on the vacuum indicator 10 so that the pressure in the deposition tank 1 may become a desired value. And, after confirming that the surface temperature on the drum-shaped substrate 6 is set at a predetermined temperature by the heater 12, glow discharge is excited in the deposition tank 1 by setting the high frequency power source 13 at a desired power.

During layer formation, the drum-shaped substrate is rotated at a constant speed by means of a motor 14 in order to uniformize layer formation. Thus, a-Si deposited film can be formed on the drum-shaped substrate 6.

The present invention is illustrated in more detail by referring to the following Examples.

EXAMPLES 1-8, COMPARATIVE EXAMPLES 1-4

Using the device for preparation of photoconductive member as shown in FIG. 3, according to the glow discharge decomposition method as described in detail above, a-Si deposited films were formed under the following conditions on 12 kinds of aluminum drum-shaped substrates, with an outer diameter of 80 mm and a thickness at the central portion of 3 mm, being shaped at the end portion as shown in FIG. 1 or FIG. 2, and having different ratios of thickness of the end portion to that of the central portion as indicated in Table 1.

| Order of lamination of deposited film | Starting gases | Film thickness (μm) |
|---|---|---|
| First layer | $SiH_4$, $B_2H_6$ | 0.6 |
| Second layer | $SiH_4$ | 20 |
| Third layer | $SiH_4$, $C_2H_4$ | 0.1 |

Temperature of the drum-shaped substrate: 250° C.
Inner pressure within the deposition tank during formation of the deposited film: 0.3 Torr
Discharging frequency: 13.56 MHz
Speed of formation of deposited film: 20 Å/sec.
Discharging power: 0.18 W/cm$^2$.

The states of the film peel-off and crack formation of the thus obtained electrophotographic photosensitive drums were observed and thereafter these photosensitive drums were set on the 400 RE copying machine produced by Canon, Inc. for image formation, and the images formed were evaluated. The results are shown also in Table 1.

When the degree of true sphericity as the end portion was measured for the photosensitive drum with a thickness ratio of 0.1 and 0.15 employing the above drum-shaped substrate with a shape at the end portion as shown in FIG. 1, the difference between the most recessed portion and the most protruded portion was about 80 μm. In contrast, for a photosensitive drum with a thickness ratio of 0.2, its difference was about 40 μm, and for photosensitive drums with a thickness ratio of 0.5 and 0.8, its difference was about 10 μm.

EXAMPLE 9

On an aluminum drum-shaped substrate having an outer diameter of 80 mm, a thickness at the central portion of 3 mm, and a shape at the end portion as shown in FIG. 1, with a ratio of the thickness at the end portion to that at the central portion of 0.3, layers were formed in the same manner in the foregoing Examples except for using $Si_2H_6$ gas in place of $SiH_4$ gas during formation of the a-Si deposited film of the second layer to prepare an electrophotographic photosensitive drum. For this electrophotographic photosensitive drum, evaluation of the state of film peel-off and crack formation and image evaluation when set on a copying apparatus were conducted similarly as in the foregoing examples. The results obtained were as good as those obtained for the photosensitive drum of Example 1 with a thickness ratio of 0.3.

TABLE 1

| | Comparative example 1 | Comparative example 2 | Example 1 | Example 2 | Example 3 | Example 4 |
|---|---|---|---|---|---|---|
| Shape of cross-section | FIG. 1 | FIG. 1 | FIG. 1 | FIG. 1 | FIG. 1 | FIG. 1 |
| Ratio of thickness at end portion to central portion | 0.10 | 0.15 | 0.20 | 0.30 | 0.50 | 0.80 |
| Number of film peel-off A*1 | 31 | 18 | 5 | 2 | 1 | 1 |
| Number of film peel-off B*1 | 11 | 6 | 2 | 1 | 0 | 0 |
| Crack | " | " | None | None | None | None |
| Evaluation of image | x | x | Δ | | | |

| | Comparative example 3 | Comparative example 4 | Example 5 | Example 6 | Example 7 | Example 8 |
|---|---|---|---|---|---|---|
| Shape of cross-section | FIG. 2 | FIG. 2 | FIG. 2 | FIG. 2 | FIG. 2 | FIG. 2 |

TABLE 1-continued

| | | | | | | | |
|---|---|---|---|---|---|---|---|
| Ratio of thickness at end portion to central portion | | 0.10 | 0.15 | 0.20 | 0.30 | 0.50 | 0.80 |
| Number of film peel-off | A*1 | 21 | 14 | 4 | 2 | 1 | 1 |
| | B*1 | 6 | 3 | 1 | 0 | 0 | 0 |
| Crack | | " | " | None | None | None | None |
| Evaluation of image | | x | x | Δ | | | |

Standard for evaluation of image:
: Very good
: Good,
Δ: Practically no problem,
x: With practical problem
A*1: Size of film peel-off: 0.3 mm ≦ ϕ ≦ 0.6 mm
B*1: Size of film peel-off: 0.6 mm < ϕ

I claim:

1. A photoconductive member which comprises a drum-shaped substrate and a photoconductive layer provided thereon, said photoconductive layer comprising an amorphous material comprising silicon atoms as a matrix and at least one of hydrogen atoms and halogen atoms and said drum-shaped substrate having a ratio of the minimum thickness at the end portions to the maximum thickness at the central portion of 0.2 or higher, wherein the end portions of the drum-shaped substrate have a thickness less than the thickness of the central portion and are adapted for attachment to a support.

2. A photoconductive member according to claim 1, wherein the drum-shaped substrate comprises aluminum.

3. A photoconductive member according to claim 1, wherein hydrogen atoms are contained in the photoconductive layer.

4. A photoconductive member according to claim 3, wherein the content of hydrogen atoms in the photoconductive layer is 1 to 40 atomic %.

5. A photoconductive member according to claim 1, wherein halogen atoms are contained in the photoconductive layer.

6. A photoconductive member according to claim 5, wherein the content of halogen atoms in the photoconductive layer is 1 to 40 atomic %.

7. A photoconductive member according to claim 1, wherein atoms belonging to the group III of the periodic table are contained in the photoconductive layer.

8. A photoconductive member according to claim 1, wherein at least one kind of atoms selected from the group consisting of oxygen atom, carbon atom and nitrogen atom is contained in the photoconductive layer.

9. A photoconductive member according to claim 1, wherein atoms belonging to the group V of the periodic table are contained in the photoconductive layer.

10. A photoconductive member according to claim 1, wherein barrier layer is provided between the substrate and the photoconductive layer.

11. A photoconductive member according to claim 1, wherein a protective layer is provided on the surface of the photoconductive layer.

12. A photoconductive member according to claim 11, wherein the protective layer has a function for preventing surface charge injection.

* * * * *

UNITED STATES PATENT AND TRADEMARK OFFICE

CERTIFICATE OF CORRECTION

PATENT NO. : 4,895,784

DATED : January 23, 1990

INVENTOR(S) : SHIGERU SHIRAI

It is certified that error appears in the above-identified patent and that said Letters Patent is hereby corrected as shown below:

COLUMN 1

Line 24, "solid state" should read --solid-state--.
Line 31, "as no" should read --as to cause no--.
Line 32, "solid state" should read --solid-state--.
Line 38, "harmless" should read --safety--.
Line 46, "applica-" should read --inventions--.
Line 47, "tions" should be deleted.
Line 49, "its application" should read --teaches its invention--.
Line 61, "drumshaped" should read --drum-shaped--.

COLUMN 2

Line 9, "inventors," should read --inventor,--.
Line 10, "thicker, and film" should read --thicker. Film--.
Line 13, "substrate which" should read --substrate. Such deformation--.
Line 17, "greatness" should read --magnitude--.
Line 24, "when applied" should read --in applications--.
Line 25, "for" should read --of-- and "defect" should read --defects.--.
Line 41, "estimated" should read --predicted--.
Line 42, "evenness in a" should read --uniformity in the--.
Line 51, "solid state" should read --solid-state--.
Line 63, "is scarce in image defect" should read --exhibits few image defects--.

UNITED STATES PATENT AND TRADEMARK OFFICE

CERTIFICATE OF CORRECTION

PATENT NO. : 4,895,784

DATED : January 23, 1990

INVENTOR(S) : SHIGERU SHIRAI

It is certified that error appears in the above-identified patent and that said Letters Patent is hereby corrected as shown below:

COLUMN 2

Line 64, "capable of giving" should read --is capable of providing--.
Line 68, "constantly" should read --uniformly--.

COLUMN 3

Line 3, "to pro-" should read --provided--.
Line 4, "vide" should be deleted.
Line 39, "certain area" should read --specified area--.
Line 51, "may be" should read --is--.
Line 57, "small, whereby t is" should read --small. Accordingly, it is now--.

COLUMN 4

Line 25, "ease and" should read --ease,--.
Line 26, "deposited of" should read --of deposited--.
Line 27, "also in aspect of economy." should read --it is economical.--.
Line 63, "method" should read --methods--.

COLUMN 5

Line 25, "may become" should read --reaches--.

UNITED STATES PATENT AND TRADEMARK OFFICE

CERTIFICATE OF CORRECTION

PATENT NO. : 4,895,784

DATED : January 23, 1990

INVENTOR(S) : SHIGERU SHIRAI

It is certified that error appears in the above-identified patent and that said Letters Patent is hereby corrected as shown below:

COLUMN 6

TABLE 1, "Evaluation of image x x Δ "

should read --Evaluation of image x x Δ ○ ⊙ ◎--.

COLUMN 7

TABLE 1-continued, "Evaluation of image x x Δ "

should read --Evaluation of image x x Δ ○ ⊙ ◎--.

and " :Very good" :Good, should read -- ◎:Very good ○:Good, --.

UNITED STATES PATENT AND TRADEMARK OFFICE

CERTIFICATE OF CORRECTION

PATENT NO. : 4,895,784

DATED : January 23, 1990

INVENTOR(S) : SHIGERU SHIRAI

It is certified that error appears in the above-identified patent and that said Letters Patent is hereby corrected as shown below:

COLUMN 8

Line 33, "barrier layer" should read --a barrier layer--.

Signed and Sealed this

Tenth Day of September, 1991

*Attest:*

*Attesting Officer*

HARRY F. MANBECK, JR.

*Commissioner of Patents and Trademarks*